United States Patent [19]

Green et al.

[11] Patent Number: 4,608,801

[45] Date of Patent: Sep. 2, 1986

[54] FLOOR BRACING MEMBER FOR A CERAMIC TILE FLOOR

[75] Inventors: William J. Green, Lake Forest; Ralph P. Semmerling, Arlington Heights, both of Ill.

[73] Assignee: United States Gypsum Company, Chicago, Ill.

[21] Appl. No.: 622,007

[22] Filed: Jun. 18, 1984

[51] Int. Cl.[4] ..... E04C 2/42

[52] U.S. Cl. ..... 52/664; 52/490; 52/668

[58] Field of Search ..... 52/335, 336, 338, 384, 52/389, 668, 690, 664, 712, 715, 317, 579, 582, 650, 732, 733, 720, 721, 490, 780, 385, 390, 488, 669; 248/343, 557

[56] References Cited

U.S. PATENT DOCUMENTS

| | | | |
|---|---|---|---|
| 1,005,012 | 10/1911 | Forsyth | 52/668 X |
| 1,035,927 | 8/1912 | Watson | 52/669 |
| 2,041,051 | 5/1936 | Dallas | 52/668 X |
| 2,186,459 | 1/1940 | Levy | 52/490 |
| 3,360,892 | 2/1968 | Rosso | 52/668 X |
| 4,151,694 | 5/1979 | Seiberg et al. | 52/338 |
| 4,193,571 | 3/1980 | Bula | 248/343 |

*Primary Examiner*—William F. Pate, III
*Assistant Examiner*—Creighton Smith
*Attorney, Agent, or Firm*—Robert M. Didrick; Samuel Kurlandsky; Robert H. Robinson

[57] ABSTRACT

Light steel joists may be spaced 24 inches o.c. under ceramic tile floors when floor bracing members are spaced at 16 inch o.c. intervals between the joists under such floors. Also made of light gauge steel, the bracing member is slotted to receive a return flange of a channel-shaped joist so that the tops of the joists and bracing members are co-planar.

10 Claims, 3 Drawing Figures

FLOOR BRACING MEMBER FOR A CERAMIC TILE FLOOR

This invention relates to the construction of interior floors having an overlay of ceramic tile. In particular, it relates to the stiffening of floor sections between joists to prevent cracking of the ceramic tile overlay.

Current ceramic tile installation specifications require 16 inch o.c. floor joist spacing and permit a floor deflection no greater than 1/360 of the span. Light steel framing systems are becoming more and more popular, partly because the framing members may be spaced 24 inches o.c. and still be structurally capable of withstanding the same loads applied to floor assemblies having 16 inch o.c. joists. The use of light steel joists in floors intended to be covered with ceramic tile has been restricted, however, because the amount of deflection that occurs under such a load may exceed that which the tile can sustain without damage.

It is an object of this invention to provide a bracing member for floors supported by light steel joists whereby vertical deflection of a sub-floor is minimized.

It is a related object of this invention to provide a crack resistant ceramic tile floor assembly comprising light steel joists spaced 24 inches o.c.

It is another related object of this invention to provide a method for stiffening floor sections spanning widely spaced light steel joists to prevent cracking of ceramic tiles bonded to the floor.

These objects, along with other objects and advantages which will become apparent, are achieved by the bracing member and floor construction illustrated by the accompanying drawings and now described with reference to said drawings, wherein.

Figure 1:
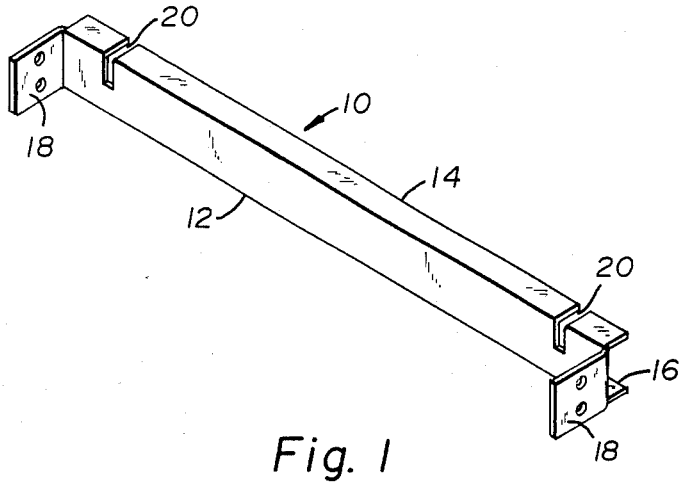
FIG. 1 is a perspective view of the floor bracing member of this invention.

In FIG. 1, the floor bracing channel 10 has a web 12, parallel flanges 14 and 16 extending perpendicularly from the web in one direction and parallel connector plates 18 which extend perpendicularly from the longitudinal ends of the web 12 in the opposite direction. A pair of slots 20 are spaced apart equidistantly from the respective longitudinal ends of the flange 14. Each slot 20 extends about half-way through the web 12 to accommodate an associated floor joist.

Figure 2:
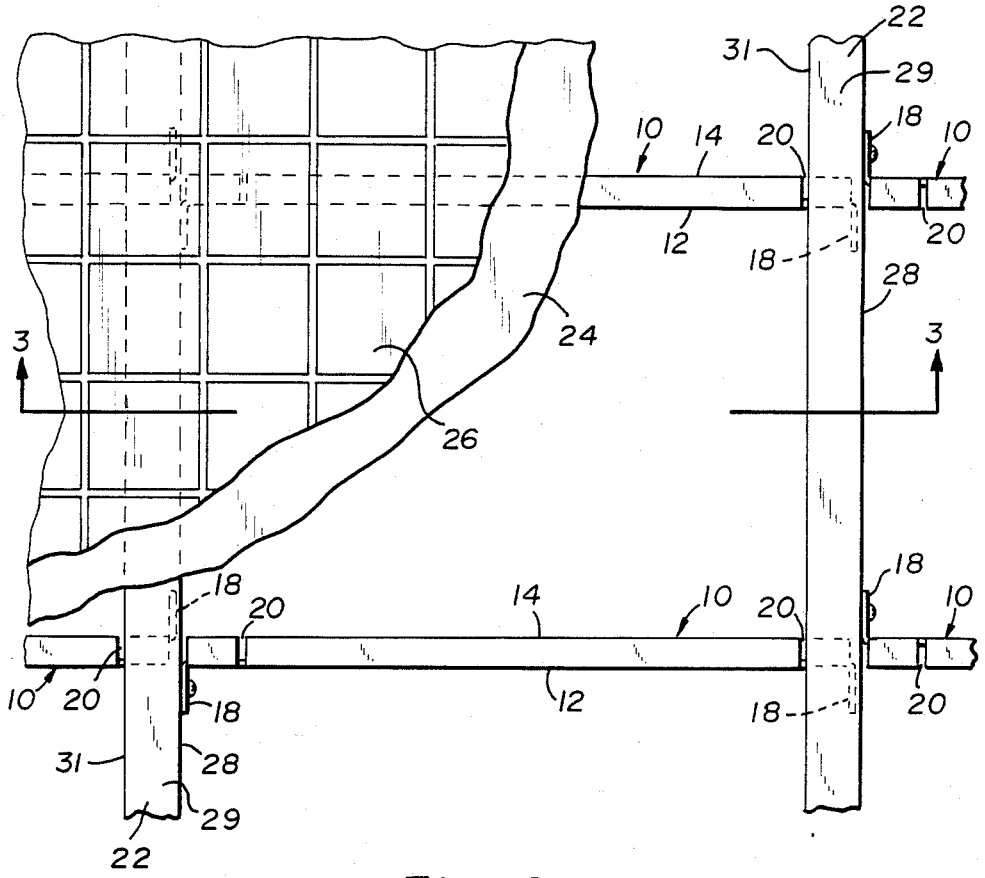
FIG. 2 is a plan view of a ceramic tile floor, partially broken away to show the joists and floor bracing members.
Figure 3:
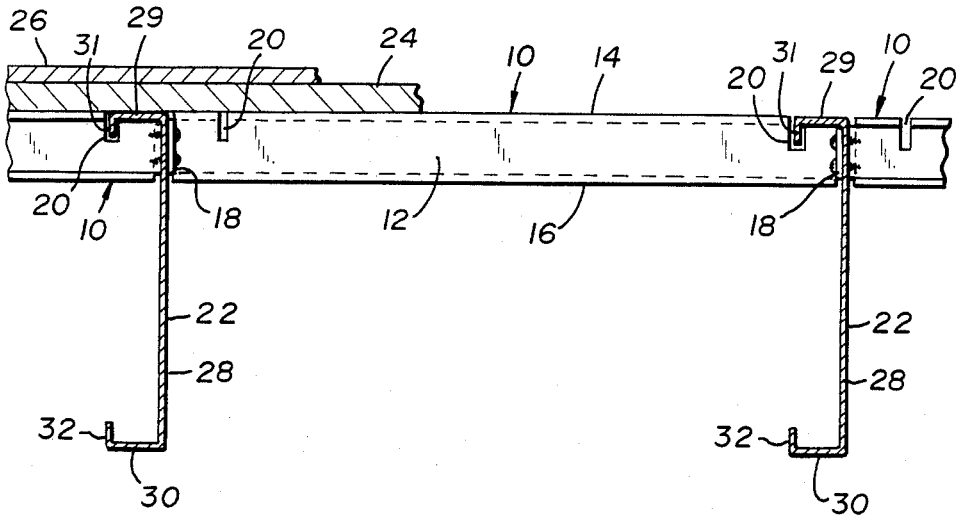
FIG. 3 is a sectional view, taken along the line 3—3 of FIG. 2, of the floor assembly of this invention.

Such an association is shown in FIGS. 2 and 3 wherein the floor joists 22 are among a plurality of parallel joists which serve as the major support for the sub-floor 24 and ceramic tile overlay 26 in co-operation with the supporting partitions and foundation of the building. The joists 22 are also channel shaped, each having a web 28, co-directional flanges 29 and 30 extending perpendicularly from the web 28, and opposing return flanges 31 and 32 which are parallel to the web 28. A slot 20 in each floor bracing channel 10 receives the return flange 31 of a floor joist 22. The connector plates 18 are fastened to the webs 28 of the joists 22 by suitable means such as bolts, screws, or weldments.

Because the distance between the slot 20 and the connector plate 18 is the same at both ends of the channel 10, every other channel in a series to be laid in a straight line across the floor assembly may be turned end-for-end, as was done in building the floor assembly of FIGS. 1 and 2. It would be less convenient but conceivable to cut only one slot 20 in each channel 10 but then the fastening of each connector plate 18 would have to await the placement and alignment of the next channel 10 so that the plates on opposite sides of the web 28 of a joist 22 could be fastened by the same bolts.

The second slot 20 of a channel 10 may receive the return flange 31 of a joist 22 whose web 28 faces away from the web of an adjacent joist 22, such as one placed at the edge of the floor.

The sub-floor in the assembly of this invention is braced by 16 inch o.c. rows of the channels 10. Despite such relatively narrow spacing, the cost of installing a ceramic tile floor in a residence may be reduced by the 24 inch o.c. spacing of the light steel joists 22 whose unit cost is quite a bit greater than that of the channels 10. In the average bathroom, the room most often having a ceramic tile floor, sixteen 24 inch long bracing channels may be used. The joists, however, serve not only to support the ceramic tile floor but are spaced at 24 inches o.c. under all of the floors of the house. The reduction in the number of joists thus required offsets by far the cost of the floor bracing channels.

The floor bracing channel 10 may be made from 16 gauge or heavier sheet steel by the conventional sheet metal forming techniques. The slots 20 may be cut less than but no more than about half-way into the web 12. The length of the cut will depend upon the size of the return flange 31, the thickness of the metal used for the bracing member 10, and tha width of the web 12. The spacing of the slots away from the end of the flanges 14 and 16 is determined by the width of the flanges 29 and 30 on the joist. Since the method of fastening the connector plates 18 to the joists is optional, the drilling of holes in the plates is also optional.

While particular embodiments of the invention have been described in detail, it will be understood that the invention may be modified within the spirit and scope of the appended claims.

The subject matter claimed is:

1. A floor assembly comprising a ceramic tile overlay; a sub-floor to which the ceramic tile overlay is bonded; a horizontal array of spaced-apart, parallel, C-shaped metal joists which serve as the major support for the sub-floor, each joist having an upright web portion, upper and lower flanges spaced apart by and extending horizontally away from the web, a pendant return flange extending perpendicularly from the upper horizontal flange; and a plurality of floor bracing members connecting adjacent joists at right angles to each, each floor bracing member comprising a web, a flange co-planar with the upper flange of an adjacent joist and extending perpendicularly in such plane from a lateral edge of the web, the flange and web of the bracing member having a common slot which receives the pendant return flange of the joist, and two connector plates, one at each longitudinal end of the web, which abut the upright webs of adjacent joists and are fastened thereto.

2. The floor assembly of claim 1 wherein the connector plates of the bracing member extend perpendicularly away from the web thereof and in the opposite direction with respect to the flange thereof.

3. The floor assembly of claim 1 wherein the floor bracing member is generally channel shaped, having a second perpendicular flange spaced apart from and parallel to the slotted flange.

4. The floor assembly of claim 1 wherein the flange and web of a floor bracing member have two common slots equidistantly spaced from the longitudinal ends of the floor bracing member.

5. The floor assembly of claim 4 wherein only one slot of a floor bracing member is occupied by a return flange of a joist.

6. A floor assembly comprising a horizontal array of spaced-apart, parallel, C-shaped metal joists which serve as the major support for a sub-floor, each joist having an upright web portion, flanges spaced apart by and extending horizontally away from the web, and return flanges extending toward each other perpendicularly from each horizontal flange; and a plurality of floor bracing members connecting adjacent joists at right angles to each, each floor bracing member comprising a web, a flange co-planar with the uppermost flange of an adjacent joist and extending perpendicularly in such plane from a lateral edge of the web, the flange and web of the bracing member having a common slot which receives a return flange of the joist, and two connector plates, one at each longitudinal end of the web, which abut the upright webs of adjacent joists and are fastened thereto.

7. The floor assembly of claim 6 wherein the connector plates of the bracing member extend perpendicularly away from the web thereof and in the opposite direction with respect to the flange thereof.

8. The floor assembly of claim 6 wherein the floor bracing member is generally channel shaped, having a second perpendicular flange spaced apart from and parallel to the slotted flange.

9. The floor assembly of claim 6 wherein the flange and web of a floor bracing member have two common slots equidistantly spaced from the longitudinal ends of the floor bracing member.

10. The floor assembly of claim 9 wherein only one slot of a floor bracing member is occupied by a return flange of a joist.

* * * * *